US005280657A

United States Patent [19]

Stagg

[11] Patent Number: 5,280,657

[45] Date of Patent: Jan. 25, 1994

[54] SHEET POSITION ADJUSTMENT ASSEMBLY AND METHOD

[76] Inventor: Marjorie H. Stagg, 32638 Lake Rd., Avon Lake, Ohio 44012

[21] Appl. No.: 950,310

[22] Filed: Sep. 24, 1992

[51] Int. Cl.[5] ..... A61G 7/012; A61G 7/015; A61G 7/10

[52] U.S. Cl. ..... 5/81.1; 5/496; 5/926; 5/611

[58] Field of Search ..... 5/81.1, 611, 83.1, 84.1, 5/625, 626, 482, 496, 926

[56] References Cited

U.S. PATENT DOCUMENTS

| | | | |
|---|---|---|---|
| 2,177,986 | 10/1939 | James . | |
| 2,291,444 | 7/1942 | Bengtson . | |
| 2,827,642 | 3/1958 | Huff | 5/81.1 |
| 2,860,352 | 11/1958 | Pierre . | |
| 2,979,737 | 4/1961 | Pierre . | |
| 3,521,308 | 7/1970 | Fowler et al. . | |
| 3,829,914 | 8/1974 | Treat | 5/81.1 |
| 4,161,044 | 7/1979 | Bogle | 5/497 |
| 4,662,016 | 5/1987 | Seeman | 5/498 |
| 4,829,617 | 5/1989 | Dameron | 5/498 |
| 4,937,904 | 7/1990 | Ross | 5/497 |
| 5,046,207 | 9/1991 | Chamberlain | 5/496 |
| 5,050,254 | 9/1991 | Murphy | 5/625 |
| 5,161,267 | 11/1992 | Smith | 5/81.1 |

FOREIGN PATENT DOCUMENTS 8909039 10/1989 PCT Int'l Appl. ..... 5/628

*Primary Examiner*—Alexander Grosz
*Attorney, Agent, or Firm*—King & Schickli

[57] ABSTRACT

A sheet position adjustment assembly comprises a sheet that overlies a support element such as a mattress on a relatively moveable frame of an adjustable bed. A pair of lengthwise adjustable straps connect the sheet adjacent the head portion of the mattress to a relatively stationary base of the adjustable bed. The straps are securely sewn to the sheet by nylon stitching. A mat of reinforcement material is sewn to the sheet at the attachment interface with the straps. A low-friction fabric panel is provided on the underside of the sheet that slides on the mattress. An upstanding rail is attached to the bed frame adjacent the head portion of the mattress to prevent collapse as the connecting straps extend thereover during the position adjustment operation. The method of adjusting the position of the sheet comprises connecting the sheet to the fixed base portion of the adjustable bed. The position of the moveable frame is then vertically adjusted upwardly by lifting or pivoting. The straps used to connect the sheet to the bed generate a pulling force as the moveable frame and mattress rise, thereby adjusting the position of the sheet and the patient positioned thereon, toward the head of the bed.

30 Claims, 3 Drawing Sheets

Fig. 1
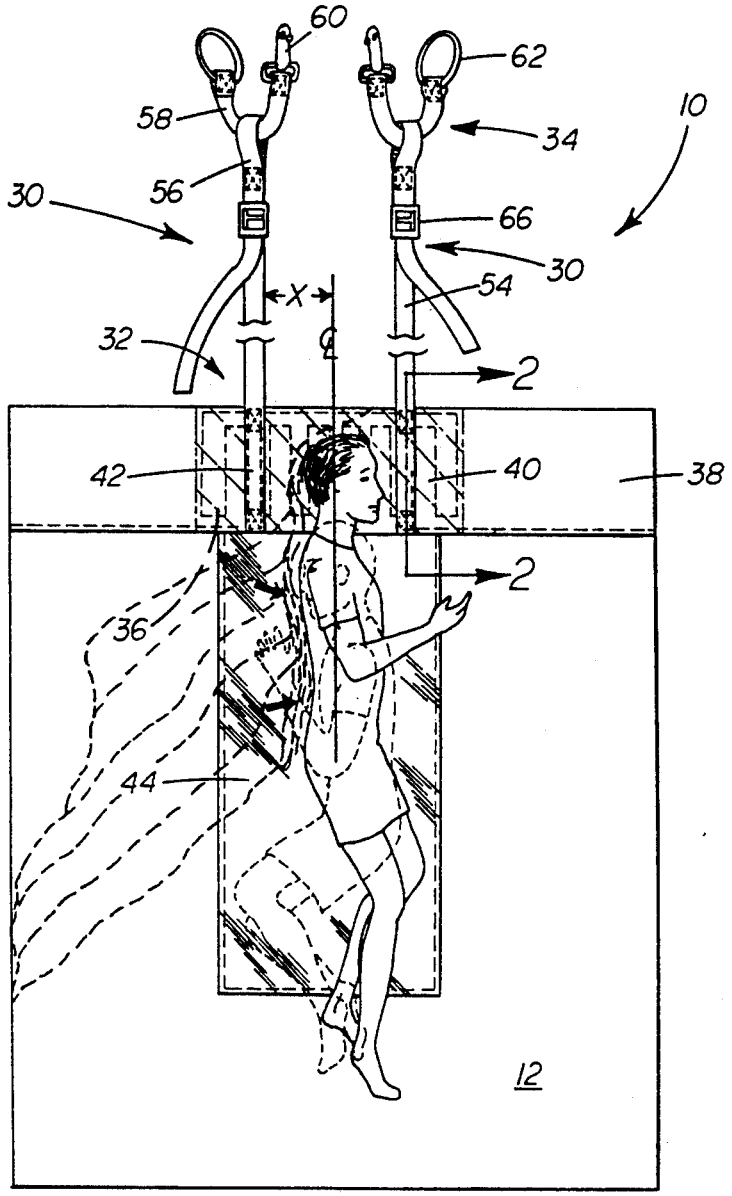
Fig. 2
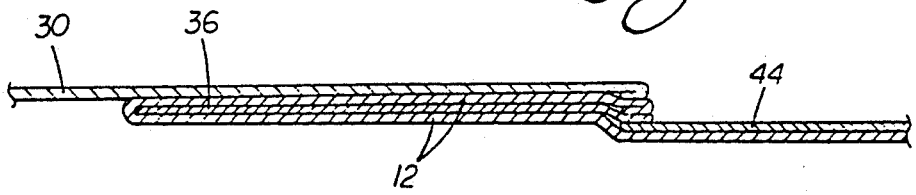
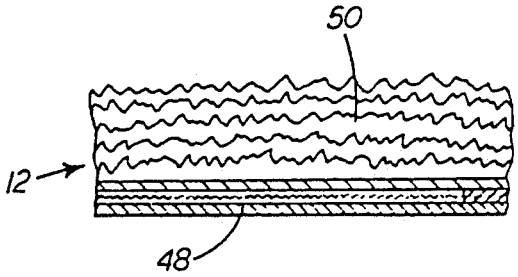
Fig. 6
ALTERNATE EMBODIMENT

ALTERNATE EMBODIMENT

ALTERNATE EMBODIMENT

SHEET POSITION ADJUSTMENT ASSEMBLY AND METHOD

TECHNICAL FIELD

The present invention relates generally to a system for adjusting the position of a sheet on an adjustable support structure and, more particularly, to a sheet position adjustment assembly and a related method for sheet adjustment for patient-supporting hospital beds.

BACKGROUND OF THE INVENTION

It is not unusual for a bed-ridden person lying either on a fitted or non-fitted sheet to gradually slide toward the foot of the bed. This is common in either a hospital or home setting, with a sick or substantially immobile patient lying in a bed. Patients frequently need to have the upper portion of the body elevated for therapeutic reasons, such as to reduce intracranial pressure, or to allow the patient to breathe more easily. When they slide down in bed, their position becomes less therapeutic and needs to be corrected. The problem is increased as the head of the bed is raised higher for the patient therapy, and during the latter stages of a patient's recovery when there are more occasions to sit up; i.e. the higher the head is raised and the more frequently it is done, the more the patient tends to slide.

The patient eventually experiences discomfort as the patient's legs become cramped against the foot guard of the bed. Furthermore, discomfort can be experienced simply due to the angle of the head of bed in relation to the foot no longer corresponding to the bending of the body at the hips. In effect, the patient's torso curves between spaced support points at the shoulders and the hips. This slumping of the patient cramps the lungs and other internal organs.

In these situations, the repositioning of the sheet upon which the patient is lying requires (1) a staff person to briefly lift and temporarily remove the patient from the bed, or (2) to physically grab hold and pull the sheet with the patient lying thereon, and pull the patient up in the bed to the desired position. It can be appreciated that these manual efforts require substantial strength. Normally, as a practical matter, two or more strong people are required to perform this function. In addition, such efforts subject the staff persons to a moderate risk of injury, as well as subjecting the patient to the considerable discomfort, as described. As one staff person can safely roll most patients, it would be particularly desirable to allow the same person, in many instances, to also move a patient up in the bed.

Generally, all hospitals, as well as many home care situations, use adjustable patient beds. Most of these beds are capable of dual position adjustments. More specifically, the bed mattress is received on a support platform that can be (1) vertically raised and lowered, and (2) pivoted about a lateral axis near the midpoint of its longitudinal dimension; that is, in the area of the patient's hips. This allows the height of the bed to be adjusted, and not only the head to be independently elevated, but also the foot of the bed to be elevated, if desired.

The support platform and mattress cooperate with a movable frame. The movable frame is attached to a base that is generally supported on the floor. The movable frame and base, and the support platform and the frame, cooperate to move with respect to each other through linkage arrangements including pivotable lever arms and cranks. The operation of the lever arms and the cranks powered by an electric motor causes the frame and the platform to be raised and lowered relative to the base, and the platform to bend at the hip line. Accordingly, both the elevation of the platform/mattress relative to the floor and the height and angle of the head of the bed relative to the foot of the bed, can be adjusted.

Considering this background, a simple assembly and method is needed to allow the patient to be pulled up in the bed while minimizing the strain on the staff persons, or home caregivers. It is contemplated that the new assembly and method take advantage of the adjustable nature of the bed to perform a position adjustment of the sheet, and thus remove most of the physical work involved. The assembly is contemplated as utilizing a modified sheet that is connected to the adjustable bed. Such an assembly would be easy to use and clean, and represent a cost efficient solution to the recognized difficulty that now exists. Such an assembly also would allow many patients, who now are in nursing homes, to be cared for at home by one caregiver of normal or limited strength.

SUMMARY OF THE INVENTION

Accordingly, it is a primary object of the present invention to provide an improved assembly and related method for overcoming the shortcomings and disadvantages described above.

Another object of the present invention is to provide an assembly that cooperates with the adjustable frame of a bed to automatically pull a sheet and the patient towards the head of the bed.

It is a further object of the present invention to provide an improved sheet position adjustment assembly, and related method of patient care, that eliminates much of the manual effort on the part of the staff or care giver person, usually requiring only a gentle rolling of the patient on the side.

Still another object of the present invention is to provide an assembly and related method that allows the sheet and a bed-ridden person lying thereon to be moved up toward the head of the bed with a minimum of discomfort and without the need to lift the person from the bed.

A further object of the present invention is to provide a sheet position adjustment assembly that is easy and economical to make, use and clean.

Still a further object is to provide an assembly and method for moving a patient up in the bed that reduces the chances of disrupting IVs, patient monitors or other attachments, and reduces the likelihood of bed sores and abrasions developing on the skin of the patient.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a novel sheet position adjustment assembly and related method for patient movement are provided. The inventive assembly cooperates with an adjustable bed with a support element to adjust the position of a sheet and patient lying thereon in response to movement of the bed frame relative to the base. This operation eliminates the routine, but difficult manual effort associated with physically pulling the sheet and the patient to effect a change in position.

In the preferred embodiment of the sheet adjustment assembly the support platform includes a mattress. The adjustment assembly further includes a connector that extends between the head of the sheet and the stationary base of the adjustable bed. Means are provided for fastening the connector both to the sheet and base. Accordingly, the position of the sheet may be adjusted in a novel manner in response to the movement of the frame, as will be seen in more detail below.

In order to assist in the position adjustment operation, the assembly includes means to alleviate the friction between the sheet and mattress opposing the sliding of the sheet. The preferred embodiment of the invention utilizes a low-friction fabric panel attached to the underside surface of the sheet. In the preferred operation, the patient is gently rolled from side to side, and the sheet repositioned under the patient so the torso and buttocks are over this panel.

Other alternative designs may be utilized to perform the friction alleviating function and facilitate the sliding of the sheet. For instance, a layered sheet may be employed that is formed of a first material layer having a relatively low friction surface for engaging the mattress, and a second, full size material layer having relatively higher friction characteristics for supporting the patient. The first surface engages the mattress of the support platform with little friction to allow the sheet to slide thereon. The second surface contacts the person who is lying on the sheet. Thus, it can be appreciated that as the position of the sheet is adjusted, the patient is carried along therewith. With this embodiment, the second surface preferably has a soft character that is friction responsive, but is non-irritating to the body. An example of such a material is natural or artificial sheepskin.

An additional alternative embodiment of the invention contemplates the use of a sheet formed of low-friction material, and including a limited area, friction responsive fabric panel attached to the upper or patient supporting surface of the sheet. As stated above, the friction responsive fabric panel is preferably a soft material, such as sheepskin, to provide comfort for body contact. It is further contemplated that this friction responsive fabric panel is detachable if desired.

While embodiments of the inventive assembly are described with each of several combinations of friction responsive and friction alleviating means, it can be appreciated that other equivalent means may be used. The design goal is to prevent relative movement between the sheet and the patient lying thereon, while simultaneously allowing the sheet to readily slide on the surface of the mattress of the support platform.

It can be visualized that a significant amount of stress is concentrated at the sheet-connector interface during position adjustment. Accordingly, the inventive assembly contemplates the use of means to reinforce the attachment between the connector and the sheet. In the preferred embodiment, the reinforcing means takes the form of a mat of reinforcement material incorporated into the sheet and to which the connector is attached. Examples of such reinforcement material are canvas or denim.

The connector is preferably fastened directly to the sheet. More particularly, heavy duty stitching, such as nylon thread, is used to sew the connector to the sheet. In so doing, the connector is also attached to the reinforcement material incorporated into the sheet. Alternatively, an extension mat may be attached to the sheet. The extension mat includes an aperture through which the connector is extended to secure the connector to the mat. Other alternative fastening means are also available with the inventive position adjustment assembly.

In order to optimize the force applied to the sheet and prevent skewing in the pulling operation, the adjustment assembly includes a first connector strap on a first side of the adjustable frame, and a second connector strap on a second side of the adjustable frame. The connector straps are attached to the sheet on opposing sides of a centerline therethrough and equidistant therefrom. Means may also be provided to further enhance equalization of the pulling force and reduce the stress at the sheet/connector interface. Advantageously, bracing straps that extend between the first connector strap and second connector strap in a crossing pattern are preferably provided to achieve this function and improved result.

To further facilitate its versatility, the inventive sheet position adjustment assembly is provided with connector straps that are lengthwise adjustable. In the preferred embodiment, the connector straps comprise at least two durable strap members that are joined by at least one adjustment member or buckle. This design also allows the connector straps to be put in an operation-ready, taut configuration to optimally transmit the movement of the bed to the sheet.

The assembly is also contemplated as including means for preventing the collapse of the forward mattress edge as the connector is pulled taut thereover during the sheet position adjustment operation. In the preferred embodiment, a rigid member cooperates with the bed frame adjacent the head portion of mattress where the connector bends over the mattress. The rigid member preferably takes the form of an upstanding rail that is constructed as part of the frame. The upstanding rail is positioned so as to substantially abut the forward edge of the mattress.

Alternatively, a rectangular block of rigid material such as wood, metal or, preferably, low friction plastic, may be placed on the support platform adjacent the head portion of the mattress over which the connector extends. It can be appreciated that other designs may be also utilized to prevent the collapse of the mattress.

The inventive assembly is particularly useful in practicing a novel method disclosed herein. In conjunction with the assembly described above, the method is particularly useful in adjusting the position of a sheet on the mattress of a bed having an adjustable frame. The method involves fastening a connector between the sheet and a fixed portion or base of the bed so as to be taut therebetween, and adjusting the frame so as to move the connector. Since the connector is fastened to the sheet, the position of the sheet is adjusted toward the head of the bed along the mattress in response to the upward movement of the frame.

The fastening step is practiced by fastening a first connector strap between the sheet and a first side of the base and fastening a second connector strap between the sheet and a second, opposing side of the base. The connectors are preferably initially lengthwise adjustable. Thus, the method also contemplates initially adjusting the connectors to form a taut configuration between the sheet and the base of the bed. Bracing straps are provided between the two connectors in a crossing pattern to further equalize the pulling force and reinforce the connector/sheet interface during the pulling operation.

The moving step of the preferred method specifically includes raising a displaceable portion of the bed frame in a vertical direction. While this may be sufficient to adjust the position of the sheet toward the head of the bed as desired, an additional advantage is provided with adjustable frames that have dual function adjustment capability. With these frames, the moving step of the preferred method also completes the position adjustment operation by pivoting the head of the support platform on the bed frame from a horizontal position to an elevated position. The composite action of the moving step involving dual movement of the frame and the platform ensures that the sheet is rapidly and properly positioned during the adjustment operation.

The method as broadly practiced may also include additional steps to facilitate operation. More specifically, the method may include alleviating the friction opposing the sliding of the underside of the sheet during the position adjustment operation. The preferred friction alleviating step involves attaching a low-friction fabric panel to the underside surface of the bottom sheet on the bed that engages the mattress. Alternatively, as described above, sliding friction may be alleviated by forming the sheet of two layers. The first or lower layer is formed from a low friction material having a relatively "slippery" surface which engages the mattress during use. The second or upper layer is formed from a relatively higher friction material to provide a surface for contacting the person lying on the sheet. Another alternative friction alleviating step comprises forming the sheet of low-friction material and attaching a friction responsive fabric panel on the non-sliding surface to contact the person.

The improved method contemplates the further step of reinforcing the connection between the connector and the sheet. The preferred step comprises incorporating a mat of reinforcement material, such as canvas or denim in the sheet. The connector is attached to both the sheet and the reinforcement material.

An additional step that further enhances the practice of the method includes preventing the collapse of the head edge of the mattress of the support platform as the connector is pulled taut thereover during sheet position adjustment operation. This step is preferably practiced by attaching a rigid member to the bed frame abutting the support element or mattress, and over which the connector extends.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 1 is a top plan view of the sheet position adjustment assembly of the present invention;

FIG. 2 is a cross sectional view of the connector/-sheet interface of the sheet position adjustment assembly taken along lines 2—2 of FIG. 1;

FIG. 6 is a partial cross-sectional view of an alternate embodiment of the sheet position adjustment assembly, showing the lamination of a friction resistant fabric and a friction responsive fabric to form the sheet;

Figure 3A:
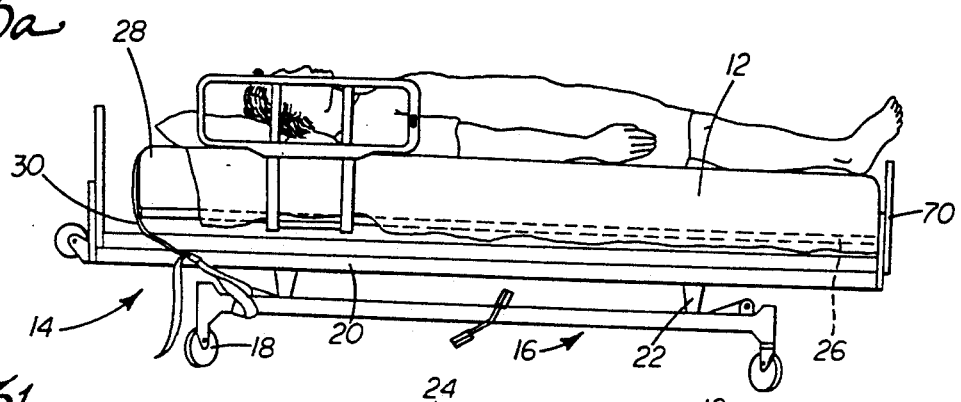
FIGS. 3*a*–3*d* show in sequence the sheet position adjustment operation as the sheet is pulled toward the head of a bed mattress of the support platform.

Reference will not be made in detail to the present preferred embodiment of the invention, an example of which is illustrated in the accompanying drawings.

DETAILED DESCRIPTION OF THE INVENTION

A sheet position adjustment assembly 10 in accordance with the teachings of the present invention is shown in FIG. 1. The assembly 10 cooperates with an adjustable frame and platform to adjust the position of a sheet 12. A primary use for the assembly 10 is to adjust the position of the bottom sheet 12 on the support element or mattress of a hospital or caregiver bed 14 to reposition the patient who has shifted toward the foot of the bed. This eliminates the need for extra hospital staff or personnel to help lift the patient in order to move him or her on the bed. For most cases, the same person that rolls the patient for movement, and for optimum center positioning on the sheet, can pull the patient back up into the proper bed position. Although the assembly 10 is adapted for applications other than in a hospital-type bed setting, for purposes of illustration, the following description of the inventive assembly and related method is directed to this particular application.

The preferred embodiment of the sheet position adjustment assembly 10 is advantageously adapted to cooperate with the standard-type adjustable hospital bed 14. As is known in the art, such a bed 14 has a base 16 that is supported on casters 18 to allow rolling on the floor. The base 16 is connected to a relatively moveable frame 20 through a linkage/crank assembly 22. The linkage/crank assembly 22 operates to raise and lower the frame 20 relative to the base 16 to change the elevation of the patient as desired (compare FIGS. 3*a* and 3*b*). The linkage/crank assembly 22 is preferably operated by manipulation of electric controls on the side guard 24 of the bed 14, or from a control that may be movable and hand-held to make it more accessible to the patient.

The bed 14 also has a support platform 26 that is pivotable about a lateral axis substantially centrally located along the longitudinal dimension of the bed. This corresponds generally to the hip-line of the patient. The support element or mattress 28 is received on the support platform 26, as shown. The sheet 12 in turn rests on the mattress 28. Accordingly, as particularly shown by comparing FIGS. 3*a* and 3*d*, the head of the bed 14 is pivotable between a horizontal position and an elevated position. The sheet position adjustment assembly 10 harmoniously cooperates with the adjustable bed 14 to slide a patient toward the head of the bed as the head of the bed is elevated.

In an important aspect of the invention, the assembly 10 includes a pair of connecting straps 30 that connect the head end of the sheet 12 to the base 16. More particularly, a proximal end 32 of each connecting strap 30 is securely attached to the sheet 12. A distal end 34 of each connecting strap 30 is removably attached to the base 16 of the bed 14 by loops (see FIG. 4). Thus, when the distal end 34 of both straps 30 is attached to the base 16 and the straps are first made taut through lengthwise adjustment, the upward movement of the bed 14 naturally causes the sheet 12 to slide toward the head of the bed (see FIGS. 3*b*–3*d*).

It can be appreciated that the weight of a patient lying on the sheet 12 creates a substantial resistance to this sliding movement. The sliding resistance in turn creates significant stress at the attachment interface between the sheet 12 and the straps 30. The sheet 12 is advantageously designed to accommodate the weight and perform the position adjustment function without tearing under the force of the sliding resistance. More specifically, as best shown in FIG. 1, the sheet 12 is reinforced at the attachment site with the straps 30. In the preferred embodiment, a mat of reinforcement material 36 is sewn into a hem 38 at the head end of the sheet 12 (see FIG. 2). The reinforcement material 36 is preferably canvas or denim. However, any material that provides sturdy support and resists tearing may be used for reinforcement at the sheet 12/connecting straps 30 interface. The stitching 40 used to sew the reinforcement material 36 to the sheet 12 is preferably applied in multiple rows, as shown in FIG. 1.

The connecting straps 30 are themselves made of sturdy, stretch resistant material and are also securely sewn to the sheet 12. Preferably, heavy duty stitching 42, also using nylon thread or the like is used to sew through overlapping plies of the hem 38 for secure attachment to the reinforcement material 36.

The inventive sheet assembly 10 contemplates other ways (not shown) of connecting the sheet 12 to the bed 14. For instance, a sturdy extension mat may be securely attached to the head portion of the sheet 12. In this design, the extension mat has a pair of holes, preferably reinforced by grommets, that receive a rope. The rope is extended through the holes and the opposing ends are tied to opposing sides of the base 16 of the bed 14.

Alternatively, a sleeve may be securely attached to the head portion of the sheet 12. With this approach, a pipe is received within the sleeve. A rope is passed through the pipe and, as with the alternative above, the opposing ends of the rope are tied to the bed base 16. Knots are tied in the rope at the exit positions from the pipe to prevent relative movement between the two components. With either design approach, it is advantageous to reinforce the attachment interface between the sheet and the extension mat or sleeve to prevent tearing during position adjustment operation.

The slidability of the sheet position adjustment assembly is further enhanced by the use of means to alleviate the friction between the sliding surface of the sheet 12 and the mattress 28. In the preferred embodiment, a low-friction fabric panel 44 is sewn to the underneath or sliding surface of the sheet 12. As shown in FIG. 1, the panel 44 is preferably attached to a central portion of the sheet 12 to be positioned directly underneath the patient's torso. Accordingly, the low-friction fabric panel 44 is optimally positioned at the area of greatest sliding resistance due to the weight of the patient.

The preferred embodiment of the assembly 10 contemplates the use of satin as the low-friction fabric panel 44. However, it can be appreciated that other low-friction fabrics that facilitate sliding may be used.

Alternatively, the sheet 12 may be formed of a low friction material itself, such as satin or the like, with a panel 46 of friction responsive fabric attached to directly engage the patient. More specifically, a panel 46 of fabric, such as natural or artificial sheepskin or the like may be incorporated into the top or patient-engaging surface of the sheet 12. Thus, the patient remains substantially stationary relative to the sheet 12 and is carried thereby as the sheet slides upward on the mattress 28 during the adjustment operation. The soft sheepskin also protects the patient's skin from irritation, such as sheet "burns" on the elbows and from decubiti (bedsores).

Figure 5:
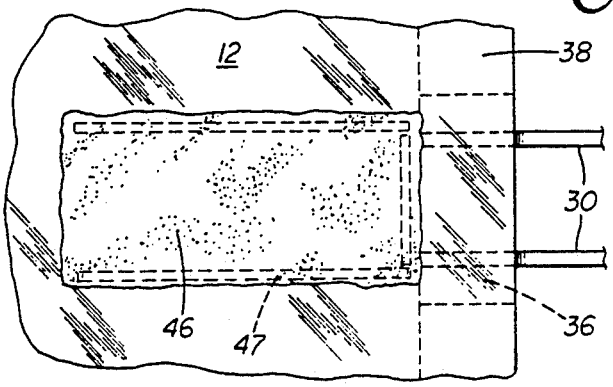
FIG. 5 is a top partial plan view of another embodiment of the sheet, showing the detachable friction responsive fabric panel on the patient supporting or non-sliding surface thereof.

As shown in FIG. 5, the panel 46 may be detachably connected to the sheet 12 with the use of hook-and-loop fastener (Velcro) strips 47. Of course, if permanent attachment is desired, the panel 46 may be sewn to the sheet 12. Both the panels 44, 46 are made to be sufficient in areas to carry out their function.

The sheet 12 may also be formed from total area layer construction. More particularly, the complete lower or bottom layer may comprise a low friction material that engages the mattress 28. The upper layer comprises a total friction responsive surface on which the patient lies. Accordingly, as illustrated in FIG. 6, a lower or underside sheet of satin 48 may be laminated, or sewn (or otherwise fastened) to an upper sheet of natural or artificial sheepskin 50 to form opposing surfaces for the inventive sheet 12. As mentioned above, other fabrics that have the appropriate friction responsive, or low friction characteristics, may be used for the respective surfaces.

As shown in FIG. 1, the preferred embodiment of the assembly 10 utilizes two straps 30 that are attached to the sheet 12 at positions that are substantially the same distance (defined as X in FIG. 1) from the center line thereof. The straps 30 are attached to opposing sides of the base 16 of the bed in order to equalize the lateral distribution of the pulling force. It is preferable to position the straps 30 in the spaced relation illustrated to prevent the sheet 12 from folding or bunching during position adjustment operation. Thus, when the sheet 12 is evenly positioned across the lateral dimension of the mattress 28, the pulling force exerted on the sheet through the straps 30 is evenly directed toward the head of the bed 14. This prevents skewing of the sheet 12 as it slides toward the head of the bed 14.

Figure 7:
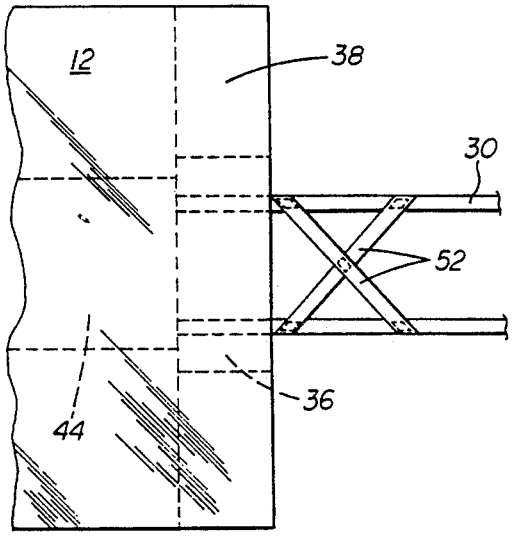
FIG. 7 is a top partial plan view of an alternate embodiment of the sheet position adjustment assembly, showing bracing straps extending between the connector straps.

While the configuration described above provides sufficient strength and stability for an even pulling force, an alternative embodiment contemplates the use of bracing straps 52 attached between the connected straps 30, as shown in FIG. 7. In the alternative design, the bracing straps 52 are preferably attached in a crossing pattern to optimize the force-sharing between the connecting straps 30. This further assists in reducing the stress at the sheet 12/connecting straps 30 interface.

Figure 4:
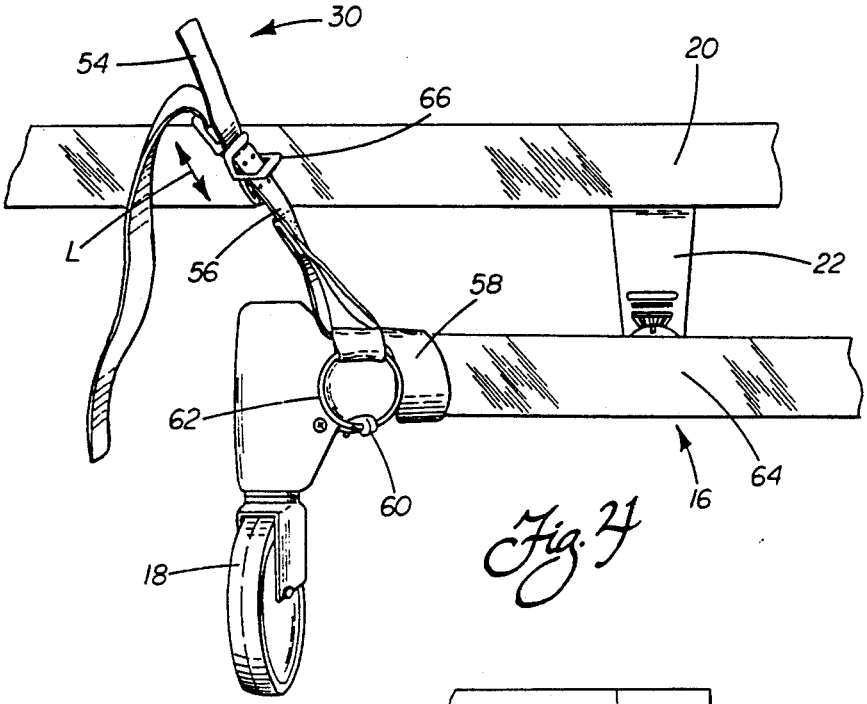
FIG. 4 is an enlarged, detail view showing the adjustable securing buckle coupling the connector strap, and the loop attachment of the strap to the base of the bed.

The straps 30 are advantageously designed to be lengthwise adjustable. More specifically, as best shown in FIG. 4, the preferred embodiment of the assembly 10 contemplates the use of a pair of durable strap members 54, 56 to form each connecting strap 30. The strap member 54 defines the portion of the connecting strap 30 that is sewn to the sheet 12. The strap member 56 is securely attached to the base 16. Preferably, a nylon belt loop 58 attaches or anchors the strap member 56. The nylon belt loop 58 is cooperatively attached to a trigger snap 60/barrel ring 62 assembly. After the loop 58 is wrapped around rail 64 of the base 16, the trigger snap 60 is clasped to the barrel ring 62 to secure the strap member 56 in place. The strap members 54, 56 are adjustably connected by a securing buckle 66. Thus, the length of the connecting straps 30 can be adjusted through the relative position of the strap members 54, 56 through the securing buckle 66 (note action arrow L in FIG. 4).

The strap members 54 are released from the buckles 66 when the sheet 12 is removed for changing the bed. This means that the portion of the entire sheet assembly 10 that is washed and dried is free of any metal parts. The buckles 66 may be magnetized or attached to a magnet (not shown) in order to hold to the bed frame 20 during sheet changes. The purpose of the magnet is to keep the staff person from having to crawl under the bed to retrieve the buckle when fastening a new sheet on the bed.

The lengthwise adjustability of the connecting straps 30 provides a number of advantages. This feature provides versatility for the assembly 10 to accommodate use with a variety of bed sizes. In addition, the connecting straps 30 are first made taut regardless of the configuration of the bed 14 in preparation for use. This optimizes the adjustment operation by preventing any loss of pulling force through slack. That is, as an adjustable bed only has a limited range of adjustability, this feature provides a way of utilizing the full range of relative motion to reposition the sheet and patient, and thus eliminate any lost motion. To put it another way, by making the straps taut prior to raising the bed, it is advantageously possible to insure that the full range of bed adjustment is utilized with each operation to move the sheet and patient toward the head of the bed.

The sheet position adjustment operation results in a substantial force applied by the taut connecting straps 30 to the head end of the mattress 28 as the straps bend thereover. As shown in FIG. 3*d*, this tends to deform the head of the mattress 28 from its standard configuration (as shown in phantom line) to a compressed configuration as shown in full line. This problem is particularly magnified when a foam mattress topper is used. It can be appreciated that the deformation of the mattress 28 absorbs a portion of the force that is intended to effect the position adjustment of the sheet 12. This in turn reduces the effectiveness of the sheet position adjustment operation.

Figure 8:
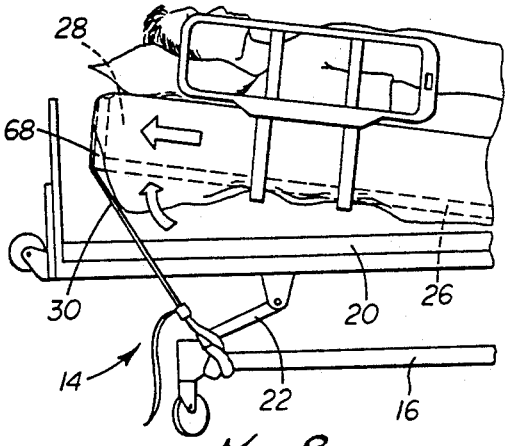
FIG. 8 is a partial view of the sheet position adjustment assembly, showing the upstanding rail attached to the adjustable support platform to prevent the collapse of the head end of the mattress as the straps are pulled taut thereover during operation.

In order to address this situation, there may be provided means to prevent the collapse of the head end of the mattress 28 during operation. As shown in FIG. 8, the preferred embodiment of the collapse preventing means is a rigid upstanding rail 68 fixed to the support platform 26 along the full lateral dimension of the mattress 28 adjacent the head thereof. The head end of the mattress 28 abuts against the upstanding rail 68, which thus provides a non-deformable surface over which the connecting straps 30 extend. By providing the upstanding rail 68 to prevent the collapse of the head of the mattress 28, the pulling force is transmitted through the connecting straps 30 without loss of motion or impairment of effect.

Alternatively, the support platform 26 may be extended to provide a surface to support a rigid block (not shown). The block may be made of wood, metal or plastic or other non-deformable, but preferably, low friction material. The block rests against the head of the mattress 28 and provides a non-deformable surface which the connecting straps 30 engage during the position adjustment operation.

Another alternative embodiment of the collapse preventing means contemplates the use of a non-deformable elongated box (not shown) that slips over the head of the mattress 28. The box acts as a shield to prevent the deformation of the head of the mattress 28.

The method of adjusting the position of a sheet overlying a support element received on an adjustable frame will now be described. For convenience and continuity, the method is detailed in the context of shifting a sheet 12 on a hospital bed 14 using the preferred embodiment of the inventive sheet position adjustment assembly 10. It can be appreciated that the method may be utilized in other applications and other environments, such as by a home caregiver.

As shown in FIG. 3*a*, the patient lying on the sheet 12 in the bed 14 has shifted downwardly on the mattress 28. In this position, the patient may experience discomfort due to the cramped position of the feet against the foot guard 70 of the bed 14. The patient who has slid down also experiences discomfort if the head of the bed is elevated, and the bend of the mattress is not aligned with the patient's hips. Also, the patient may need to have the upper portion of the body elevated for therapeutic reasons.

To address this problem, the bed 14 is first lowered to its lowest position, as shown in FIG. 3*a*. The connecting straps 30 are released from the buckles 66 so that the head end (at the hem 38) of the sheet 12 can be pulled up, and then down toward the patient. The patient is rolled from side-to-side as the sheet is pulled down, first from one side and then the other (see dashed-line outline in FIG. 1). During this procedure, the sheet is wrinkled and tucked under the back of the patient until it can be pulled down, first on one side and then the other, so that the patient's head can be once again aligned with the hem 38 at the sheet's head end (see full-line patient position of FIG. 1).

Once this final pulled-down position of the sheet 12 is reached, the straps 30 are re-adjusted to the buckles 66 and pulled to a fully taut configuration. The taut configuration is secured through the buckles 66 to prevent the slipping of the straps 30 relative to the strap members 54, 56. The sheet 12 is now prepared to take advantage of the adjustable movement of the bed 14. More specifically, as the position of the bed 14 is adjusted upwardly, the sheet 12 with the patient is shifted on the mattress 28. This then effectively repositions the patient toward the head of the bed 14, that is, pulls the sheet 12 and the patient up into the proper aligned positions (see FIG. 3*d* and full line patient of FIG. 1).

Figure 3B:
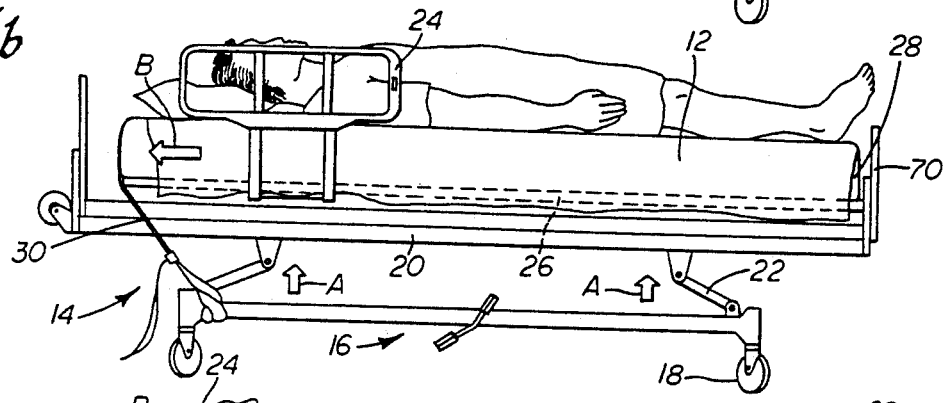

To review the action further, reference is made back to FIG. 3*b*. The frame 20 is lifted relative to the base 16 in accordance with action arrows A. This is preferably accomplished through automatic motion responsive of the linkage and crank assembly 22. This action is responsive to manipulation of an electric control switch integrated into the side guard 24 of the bed 14 or on a hand-held control. Alternatively, the frame 20 may be raised through a manual cranking operation.

As the frame 20 ascends, the tautness of the connecting straps 30 causes a pulling force on the sheet 12. As a result, the sheet 12 is drawn toward the head of the bed 14 in accordance with action arrow B.

As the frame 20 is lifted, the sheet 12 is shifted upwardly or forwardly on the mattress 28 to the desired position, as described. If, however, the frame 20 is raised to its maximum height and the sheet 12 has not reached the desired position, the pivoting action of the support platform 26 may be initiated to complete the sheet position adjustment operation.

Figure 3C:
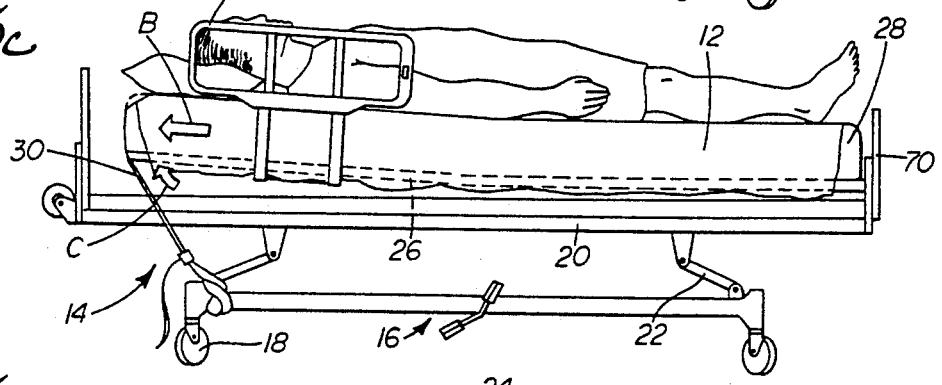
Figure 3D:
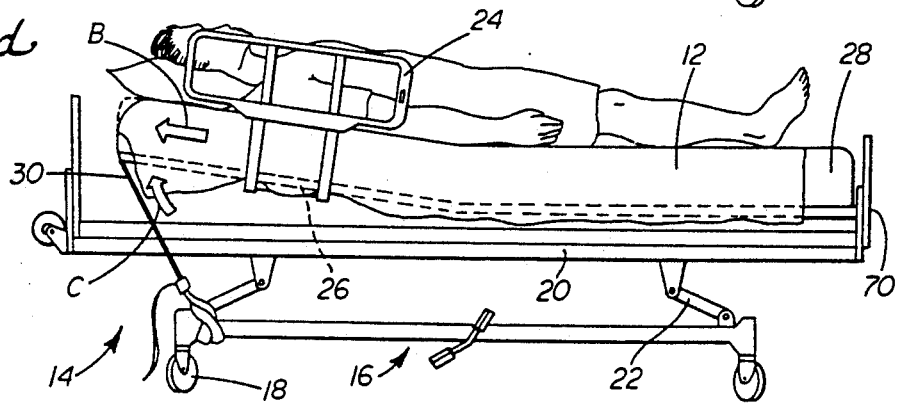

As shown in FIG. 3*c*, the head portion of support platform 26 and mattress are rotated about a lateral axis that is substantially centrally located along the longitudinal dimension of the bed 14. This pivoting action folds the mattress and elevates the head of the bed 14, as indicated by action arrow C. The tautness of the connecting straps 30 preserves the pulling force on the sheet 12. This continues the forward shifting of the sheet 12 toward the head of the bed 14.

If a patient still does not reach the fully pulled up position of FIG. 3*d*, that is, where the hips are aligned with the fold in the mattress, the movable frame 20 and platform 26 may be lowered so that the connecting straps 30 are retightened in a taut condition. The frame 20 and/or platform 26 may then again be raised to further reposition the sheet 12 and patient toward the head of the bed as desired. This is another important function of the longitudinally adjustable straps 30.

It can be appreciated that sheet position adjustment is achievable in response to either of the individual adjustment movements of the bed 14 or the combination thereof. As described above, the lifting of the frame 20 is contemplated as being sufficient to accomplish the position adjustment operation. However, if this movement does not produce the desired result, the pivoting of the support platform 26 is carried out to complete the adjustment operation through composite action, as described. Alternatively, the pivoting movement of the head portion of the support platform 26 alone may achieve the desired repositioning of the sheet 12. Simply stated, the practice of the inventive method involves the movement of the adjustable bed 14 to produce the sheet position adjustment operation.

In summary, numerous benefits result from the use of the inventive sheet position adjustment assembly 10 and the practice of the novel sheet position adjustment operation. Sturdy connecting straps 30 are securely attached to the sheet 12 and to the base 16 of the adjustable bed 14. The lifting of the frame 20 and, if needed, the pivoting of the support platform 26 generate a pulling force transmitted through the connecting straps 30 to adjust the position of the sheet 12 on the bed 14. The mat of reinforcement material 36 is sewn to the sheet 12 at the attachment interface with the straps 30 to protect against tearing during the position adjustment operation. A low-friction fabric panel 44 is attached to the sliding surface of the sheet 12 to facilitate sliding movement.

Accordingly, the position of a patient lying on the sheet 12 who has slid downwardly in the bed 14 may be shifted forwardly or pulled up toward the head of the bed without having to lift the patient. This not only prevents the possibility of inadvertent injury to the hospital personnel, but also results in a more comfortable shifting operation for the patient.

The foregoing description of a preferred embodiment of the invention has been presented for purposes of illustration and description. It is not intended to be exhaustive or to limit the invention to the precise form disclosed. Obvious modifications or variations are possible in light of the above teachings.

For example, different mechanisms are used to achieve the movements of the portions of the bed. For instance, some beds have legs that telescope to raise and lower the movable frame, rather than utilizing pivotable arms and cranks. Such beds would require the use of different attachment methods. It is contemplated that on such beds, a collar would be mounted just above the wheels on the legs. Then, the distal end of strap 30 is fastened to the collar. Alternatively, the strap is attached below the collar, with the collar being used to keep the straps from sliding up the leg of the bed. For the latter alternative, a loop may be woven or sewn in the distal end of strap 30.

The preferred embodiment, and the alternative arrangements, were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A sheet position adjustment assembly in combination with an adjustable bed having a head portion and a foot portion, to move a patient longitudinally along said bed, said bed including a vertically moveable frame receiving a support element for the patient and a stationary base, comprising:

a sheet overlying said support element;

a connector adjacent the head portion extending between said sheet and said base;

means for fastening said connector to said sheet; and means for attaching said connector to said base, whereby the adjustment of said moveable frame pulls said sheet to effect a position adjustment of said sheet and the patient by sliding toward said head portion.

2. The sheet position adjustment assembly as in claim 1, further including means to reinforce the connection between said connector and said sheet.

3. The sheet position adjustment assembly as in claim 2, wherein said reinforcing means comprises a mat of reinforcement material incorporated into said sheet and to which said connector is attached.

4. The sheet position adjustment assembly as in claim 3, wherein said reinforcing material is canvas or denim.

5. The sheet position adjustment assembly as in claim 3, wherein said fastening means comprises heavy duty stitching.

6. The sheet position adjustment assembly as in claim 5, wherein said stitching comprises nylon thread.

7. The sheet position adjustment assembly as in claim 1, further including means to alleviate the friction opposing the sliding of said sheet during position adjustment.

8. The sheet position adjustment assembly as in claim 7, wherein said friction alleviating means comprises a low-friction fabric panel attached to the underside of said sheet.

9. The sheet position adjustment assembly as in claim 1, wherein said support element comprises a mattress and said sheet includes two layers, a first, underside layer being formed from a low friction material for engaging said mattress and a second, upper layer of relatively higher friction material for engaging the patient.

10. The sheet position adjustment assembly as in claim 9, wherein said second layer has a soft character for non-irritating body contact with the patient and to be friction responsive to assure movement of the patient with said sheet.

11. The sheet position adjustment assembly as in claim 10, wherein said second, upper layer is sheepskin.

12. The sheet position adjustment assembly as in claim 7, wherein said friction alleviating means comprises said sheet being formed of low-friction material.

13. The sheet position adjustment assembly as in claim 12, wherein said sheet includes a friction responsive fabric panel for positioning of the patient to assure movement of said patient with said sheet.

14. The sheet position adjustment assembly as in claim 13, wherein said friction responsive fabric panel is detachable.

15. The sheet position adjustment assembly as in claim 13, wherein said friction responsive fabric panel has a soft character for non-irritating patient contact.

16. The sheet position adjustment assembly as in claim 15, wherein said friction responsive fabric panel is sheepskin.

17. The sheet position adjustment assembly as in claim 1, wherein said connector includes a pair of spaced connector straps attached to said sheet on opposing sides of a center line therethrough and equidistant therefrom.

18. The sheet position adjustment assembly as in claim 17, wherein said connector further including bracing straps extending between said connector strap members in a crossing pattern.

19. The sheet position adjustment assembly as in claim 1, wherein said connector is lengthwise adjustable to draw taut prior to the position adjustment operation.

20. The sheet position adjustment assembly as in claim 19, wherein said connector comprises a pair of strap members joined by and detachable from a length adjustment member.

21. The sheet position adjustment assembly as in claim 20, wherein said length adjustment member is a securing buckle.

22. The sheet position adjustment assembly as in claim 1, further including means for preventing the collapse of said support element as said connector is pulled taut thereover during sheet position adjustment operation.

23. The sheet position adjustment assembly as in claim 22, wherein said collapse preventing means comprises a rigid member cooperating with said frame and over which said connector extends.

24. The sheet position adjustment assembly as in claim 23, wherein said rigid member comprises an upstanding rail attached to said frame adjacent the head portion of said support element.

25. A method of adjusting the position of a sheet overlying a support element received on an adjustable bed having a head portion and a foot portion to move a patient including a relatively moveable frame and a stationary base, comprising the steps of:

fastening a connector adjacent said head portion between said sheet and said base so as to be taut therebetween; and adjusting the position of said frame relative to said support element, so as to pull said sheet;

whereby said sheet and said patient are adjustably slid toward the head portion in response to adjustment of said frame.

26. The method as in claim 25, wherein said adjusting step comprises raising said moveable frame in a substantially straight vertical direction.

27. The method as in claim 25, wherein said adjusting step further includes pivoting the head portion of said frame from a horizontal position vertically upward toward an elevated position.

28. The method as in claim 25, wherein said fastening step comprises:

loosely fastening said connectors between said sheet and said base; and then lengthwise adjusting the connectors so as to be taut between said sheet and said frame.

29. The method as in claim 25, further including the step of alleviating the friction opposing the sliding on the underside of said sheet by positioning the patient over a low friction portion of the sheet during position adjustment.

30. The method as in claim 25, further including the step of preventing the collapse of said support element at the head portion as said connector pulls said sheet thereover during said position adjustment operation.

* * * * *